US009516719B2

(12) United States Patent
Stevens

(10) Patent No.: US 9,516,719 B2
(45) Date of Patent: Dec. 6, 2016

(54) ACTIVE FLICKER CANCELLATION IN LIGHTING SYSTEMS

(71) Applicant: TerraLUX, Inc., Longmont, CO (US)

(72) Inventor: Arthur Lionel Stevens, Longmont, CO (US)

(73) Assignee: TerraLUX, Inc., Longmont, CO (US)

( * ) Notice: Subject to any disclaimer, the term of this patent is extended or adjusted under 35 U.S.C. 154(b) by 0 days.

(21) Appl. No.: 14/710,970

(22) Filed: May 13, 2015

(65) Prior Publication Data

US 2015/0245440 A1 Aug. 27, 2015

Related U.S. Application Data

(63) Continuation of application No. 13/950,985, filed on Jul. 25, 2013, now Pat. No. 9,060,410.

(51) Int. Cl.
*H05B 33/08* (2006.01)

(52) U.S. Cl.
CPC ..... *H05B 33/0848* (2013.01); *H05B 33/0851* (2013.01); *H05B 33/0854* (2013.01); *H05B 33/0884* (2013.01)

(58) Field of Classification Search
CPC ..... H05B 33/0848; H05B 33/0851; H05B 33/0854; H05B 33/0884
USPC ..... 315/148–158
See application file for complete search history.

(56) References Cited

U.S. PATENT DOCUMENTS 5,783,909 A * 7/1998 Hochstein ..... H05B 33/0818 315/158
6,552,495 B1 * 4/2003 Chang ..... F21V 23/04 315/158
2006/0038916 A1 2/2006 Knoedgen et al.
2009/0140659 A1 6/2009 Kurt et al.
2009/0231354 A1 9/2009 Blaut et al.
2011/0193486 A1 8/2011 Hempelmann et al.
2011/0309754 A1 * 12/2011 Ashdown ..... H05B 33/0869 315/151
2012/0119662 A1 5/2012 Radermacher
2012/0249013 A1 10/2012 Valois et al.
2012/0319586 A1 12/2012 Riesebosch
2012/0319592 A1 12/2012 Riesebosch
2012/0321321 A1 12/2012 Riesebosch (Continued)

FOREIGN PATENT DOCUMENTS

EP 2403120 A2 1/2012
WO 2008/045531 A2 4/2008
WO 2015/013611 A1 1/2015

OTHER PUBLICATIONS

Bristow et al., "A Survey of Iterative Learning Control", A Learning-Based Method for High-Performance Tracking Control, IEEE Control Systems Magazine, Jun. 2006, pp. 96-114.

(Continued)

*Primary Examiner* — Douglas W Owens
*Assistant Examiner* — Jonathan Cooper
(74) *Attorney, Agent, or Firm* — Neugeboren O'Dowd PC

(57) ABSTRACT

Compensating for disturbances in light output by a light source includes sensing light output by a light source and generating a light-sense signal based thereon, detecting a disturbance in the light-sense signal, and generating an output signal to compensate for the disturbance. An LED is driven in accordance with the periodic output signal to thereby compensate for the periodic disturbance.

19 Claims, 8 Drawing Sheets

(56) References Cited

U.S. PATENT DOCUMENTS

| | | | | |
|---|---|---|---|---|
| 2013/0257294 | A1* | 10/2013 | Pan | H05B 37/02 315/158 |
| 2015/0028748 | A1 | 1/2015 | Stevens | |

OTHER PUBLICATIONS

Francis et al., "The Internal Model Principle of Control Theory", Automatica, vol. 12, No. 5, 1976, pp. 457-465.

Longman et al., "Iterative Learning Control and Repetitive Control for Engineering Practice", International Journal of Control, vol. 73, Issue 10, 2000, pp. 930-954.

PCT International Patent Application No. PCT/US2014/048192, International Search Report and Written Opinion mailed Nov. 20, 2014, 9 pages.

Wang et al., "Survey on Iterative Learning Control, Repetitive Control, and Run-to-Run Control", Journal of Process Control, vol. 19, 2009, pp. 1589-1600.

* cited by examiner

ACTIVE FLICKER CANCELLATION IN LIGHTING SYSTEMS

RELATED APPLICATION

This application is a continuation of U.S. patent application Ser. No. 13/950,985, filed on Jul. 25, 2013, the entire disclosure of which is hereby incorporated herein by reference.

TECHNICAL FIELD

Embodiments of the present invention related to lighting systems such as light-emitting diode ("LED") lights and, in particular, to regulating lighting drive currents.

BACKGROUND

LEDs emit an amount of light that depends upon the amount of current driven through them. Typical LED driver circuits regulate this current to keep it constant, assuming that if the driver current is constant, the LED light output will also be constant. In practice, however, the drive-current-to-light-output characteristic of LEDs may vary from LED to LED due to manufacturing defects or inconsistencies, different operating conditions for different LEDs, or other factors. These variations result in the light output of a particular LED at a given current being different from that of another LED of the same intended design. At most, existing systems may adjust LED light output in response to a sensed ambient light level, but this adjustment does not account or correct for variations in the LEDs themselves.

An example of an existing LED control circuit 100 appears in FIG. 1. One or more LEDs 102 are to be driven by a desired setpoint current $I_{SP}$. A driver circuit, such as a pulse-width-modulation ("PWM") circuit 104, emits a signal that has an average (DC) value that will result in the average current flowing through the LEDs being equal to the desired setpoint current $I_{SP}$; via the action of, for example, high gain negative feedback; the output of the PWM may be filtered by a low-pass filter 106. The current driving the LEDs 102 is sampled (by, e.g., sensing the current with a resistor $R_S$ and amplifying the sensed current with an amplifier 108). A comparator 110 compares (e.g., subtracts) the sensed and amplified LED current with the desired current $I_{SP}$ and produces an error signal e. A dynamic compensator 112 generates a control signal u based on the received error signal e, and the PWM circuit 104 adjusts the duty cycle of its output pulses accordingly (e.g., it increases its duty cycle if the sensed LED current is lower than the desired current $I_{SP}$ or decreases its duty cycle if the sensed LED current is greater than the desired current $I_{SP}$). The value of the desired current $I_{SP}$ may be varied (by, e.g., a dimmer circuit) to control the brightness of the light output by the LEDs 102.

The circuit 100 shown in FIG. 1 may be represented as a single-input-single-output ("SISO") control loop 200, as shown in FIG. 2. The dynamic compensator 112 is represented by a first transfer function G(s,z), which (like the other transfer functions in FIG. 2) may be a continuous-time analog (s-domain) or a discrete-time digital (z-domain) function. A second transfer function P(s,z) represents both the PWM circuit 104 and the low-pass filter 106 in s or z domains, and a third transfer function $K_S R_S$ represents the both the current sense resistor $R_S$ and the amplifier 108. A fourth transfer function H(s,z) represents the quasi-linear LED-current-to-light-output characteristics of the LEDs 102 over the range of regulated operating current. Because H(s,z) is not precisely known and varies from one set of LEDs to another, however, a given LED current value $I_{LED}$ produces different amounts of light produced by different LEDs. In other words, the actual value of the light output by the LEDs 102 at any time is determined by the static and/or dynamic characteristics of the transfer function H(s,z), which varies among LEDs intended to be identical.

A need therefore exists for a way to account and correct for variations in light output produced by variations in LED design, manufacture, operating conditions, or age.

SUMMARY

In general, various aspects of the systems and methods described herein include directly detecting (with, e.g., a light sensor) light emitted from one or more LEDs and determining from the detected light if and what kind of disturbances exist in the light. For example, the output light may have a static offset from an expected amount of light and/or a time-varying offset. As the term is used herein, a "time-varying" offset or disturbance refers to any increase or decrease in the light emitted by the LEDs over time (that is not otherwise caused by, for example, intentional dimming of the LEDs). The time-varying offset may or may not be periodic, but is not static. The disturbance is modeled and the signal driving current through the LEDs modified in accordance with the model. The disturbance can be detected in the light output by a light sensor or by another LED acting as a light sensor, in which case the current in the problematic LED is varied to correct the disturbance. The disturbance can, alternatively or in addition, be caused by other light sources; in this case, the LED current may be modified to cancel out these other disturbances (even if the LED itself had a normal output with no disturbance originally). For example, if the ambient light is flickering, the control system may cause a compensating flicker in the LED which is in antiphase with the ambient light disturbance in order to "average out" the overall light, resulting in a constant light level in the room. Thus, by correcting disturbances sensed in LED output light, the proper (i.e., expected) LED output can be achieved regardless of the underlying cause of improper or deviating LED operation. This approach is particularly useful in situations where the necessary output correction is more complex than a simple adjustment to the supplied current, and where the disturbance can be modeled accurately in the time domain.

The nature of the model depends on the disturbance and the desired sophistication of the system—i.e., the trade-off between more accurate correction and cost/complexity. For example, if the disturbances are known to be sinusoidal in nature (or sinusoidal correction is operationally adequate even if the disturbance is more complex), a so-called "runout filter" may be employed. In general, if the disturbance is periodic but not necessarily sinusoidal, correction based on "repetitive control" (RC) or "iterative learning control" (ILC) may be employed. To accurately correct aperiodic disturbances, a negative feedback controller may be added/combined with the RC/ILC strategy. The combined control system configuration is then able to reduce both periodic and non-periodic disturbances. Because conventional negative feedback systems have an inherent response lag, however, they may not completely cancel aperiodic disturbances (unlike periodic disturbances; if the disturbance is the same each repetition, the learning control portion of the overall system may completely cancel these types of periodic disturbances). Thus, non-periodic disturbances may be reduced to only a certain low level, depending on the design of the negative feedback control portion of the system. In some embodiments, a single approach is chosen and implemented in the final system design. In other embodiments, multiple correction modeling methodologies are employed and the optimal approach is selected based on the sensed nature of the disturbance.

In one aspect, a system for compensating for disturbances in light output by a light source includes a light sensor configured for sensing light output by a light source and for generating a light-sense signal based thereon. A compensator circuit is configured for detecting at least one characteristic of a time-varying disturbance in the light-sense signal and generating a compensating output signal based at least in part thereon. A driver circuit is configured for driving an LED in accordance with the output signal to thereby compensate for the time-varying disturbance.

The at least one characteristic of the time-varying disturbance may be at least one of (i) a frequency, (ii) a wave form, or (iii) whether the disturbance is dynamic and, if so, whether it exhibits periodicity. The compensator circuit may be further configured for selecting a signal model based on the at least one characteristic; the output signal may be generated using the signal model. A negative feedback controller may be included to compensate for an aperiodic component of the disturbance.

The light source may be the driven LED, LED string, or a source other than the driven LED and/or may not be in electrical communication with the system. The compensator circuit may include at least one of a repetitive controller, an iterative-learning controller, or run-to-run controller a digital processor and memory, and/or an integrator for detecting a static disturbance. The compensator circuit may implement a transfer function for generating the output signal. A light shield may shield the light sensor from light not produced by the LED.

In another aspect, a method for compensating for disturbances in light output by a light source includes sensing light output by a light source and generating a light-sense signal based thereon, detecting a time-varying disturbance in the light-sense signal, generating a compensating output signal based at least in part thereon, and driving an LED in accordance with the output signal to thereby compensate for the time-varying disturbance.

The at least one characteristic of the time-varying disturbance may be at least one of (i) a frequency, (ii) a wave form, or (iii) whether the disturbance is dynamic and, if so, whether it exhibits periodicity. The disturbance may be aperiodic and a negative feedback controller may be configured for generating the output signal based on iterative learning of the disturbance. A signal model may be selected based on the at least one characteristic, wherein the output signal is generated using the signal model. The light source may be the LED and/or a source other than the LED. The disturbance may be static. Generating the output signal may include generating a sinusoid. Detecting the period disturbance may include comparing the light-sense signal with a reference signal.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations. As used herein, the term "substantially" or "approximately" means±10% (e.g., by weight or by volume), and in some embodiments, ±5%.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

In one embodiment of the present invention, a light sensor measures the light produced by one or more LEDs and, using a compensator, controls the light output in accordance with the sensed light to keep the light output constant and/or follow a prescribed pattern of variation using a varying setpoint signal. The light sensor may indicate that the light produced by the LEDs differs from a desired amount by a constant offset and/or by a time-varying offset. The compensator may detect the nature of the offset (static and/or dynamic) and, based on the detected offset, generate a control signal that drives or varies the LED current in such a way as to compensate for the offset (e.g., the LED current is increased during the times at which the light output is determined to be too low and vice versa). In one embodiment, the compensator models a time-varying disturbance in the LED light output and uses the model to create the control signal. The compensator may adjust the LED current in response to changes in the LED light output, changes in light output by a different light source, and/or changes in ambient light.

Figure 1:
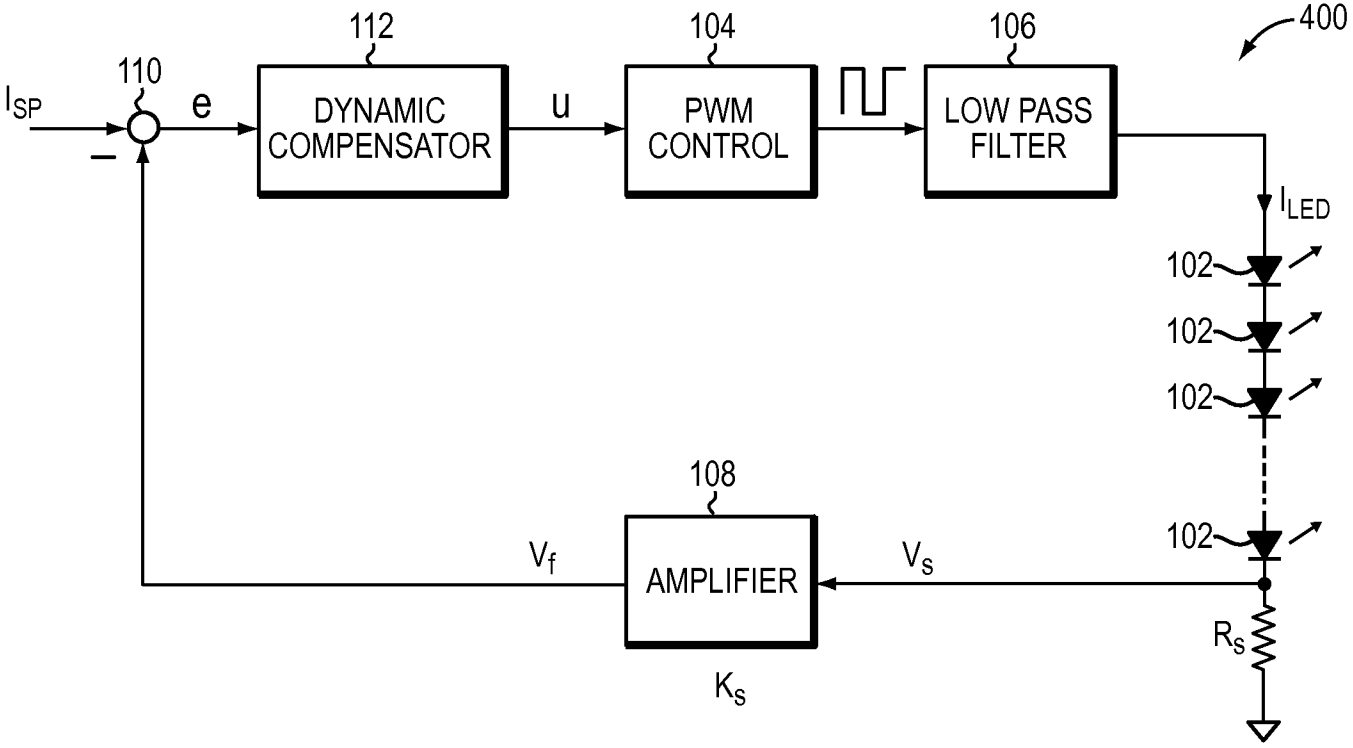
FIG. 1 PRIOR ART
FIG. 1 illustrates a conventional circuit for regulating current in one or more LEDs.
Figure 2:
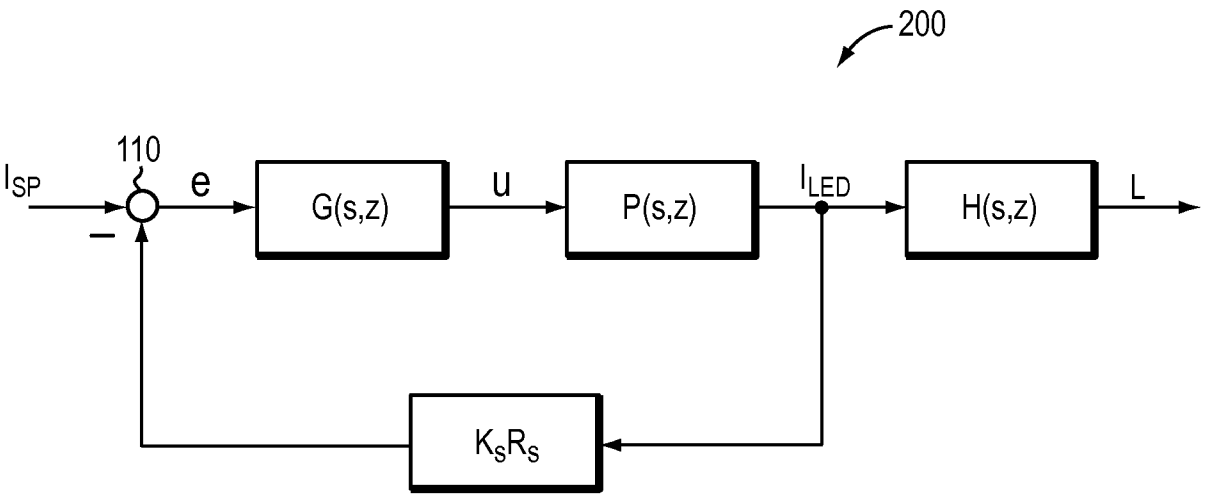
FIG. 2 PRIOR ART
FIG. 2 illustrates a conventional control loop for regulating current in one or more LEDs.
Figure 3:
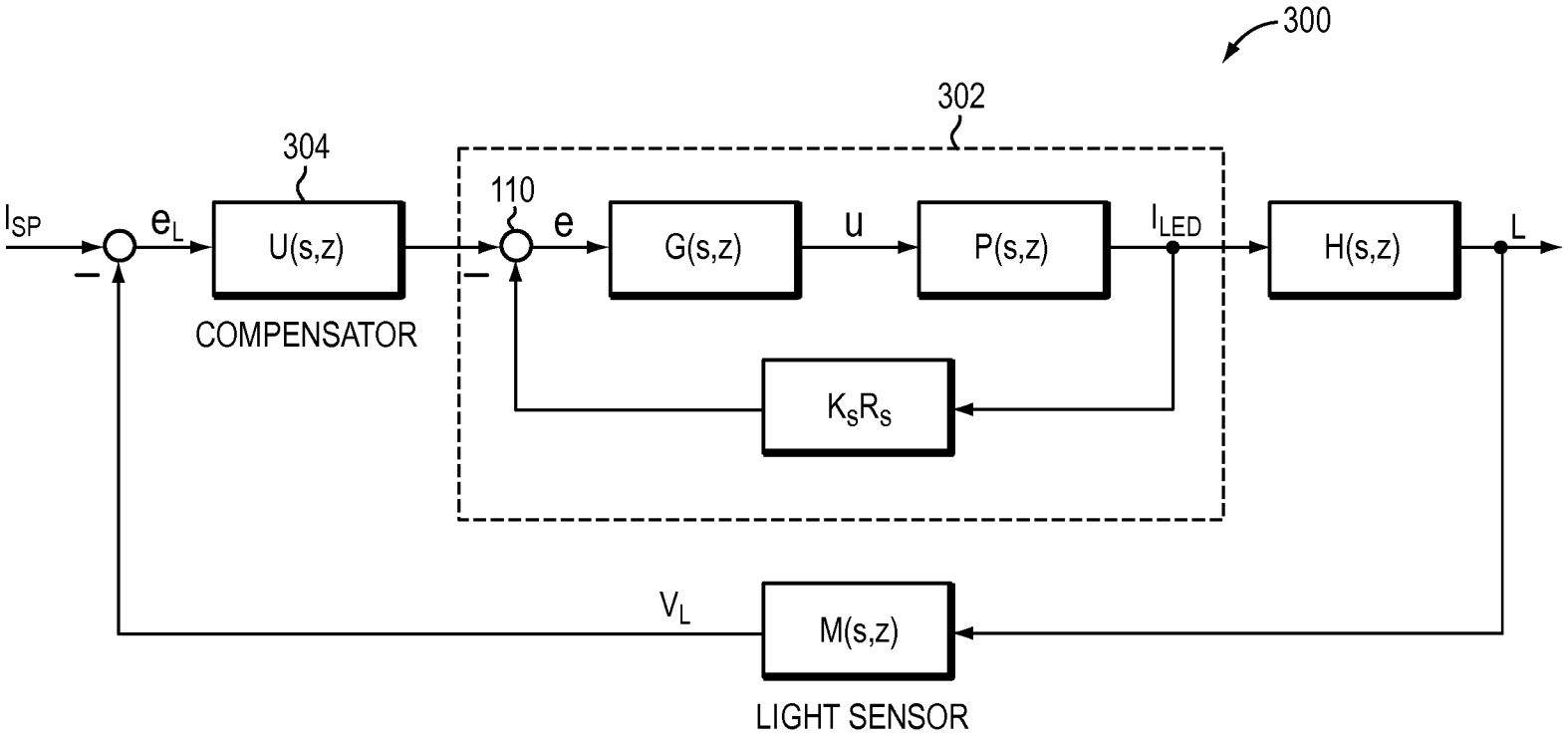
FIG. 3 illustrates a control loop for regulating current in one or more LEDs based on LED light output in accordance with embodiments of the present invention.

A control-loop block diagram 300 for compensating for variations in detected light is illustrated in FIG. 3. A first feedback loop 302 includes a first transfer function G(s,z) representing a dynamic compensator, a second transfer function P(s,z) representing a PWM circuit and a low-pass filter (or similar driver circuit), and a third transfer function $K_S R_S$ representing a current sensor (e.g., resistor and amplifier). The LED current-to-light-output characteristic is represented by another transfer function H(s,z). A light sensor M(s,z) detects light output L by the LEDs (and/or other sources) and produces a representative signal $V_L$. A compensator receives the output $V_L$, of the light sensor M(s,z) and, in accordance with its transfer function U(s,z), [U(s,z)] compensates for static and/or dynamic disturbances in the light output L. In one embodiment, a comparator 306 compares the output $V_L$, of the light sensor with a desired current $I_{SP}$ to produce an error signal $e_L$, used by the compensator U(s,z).

Figure 4:
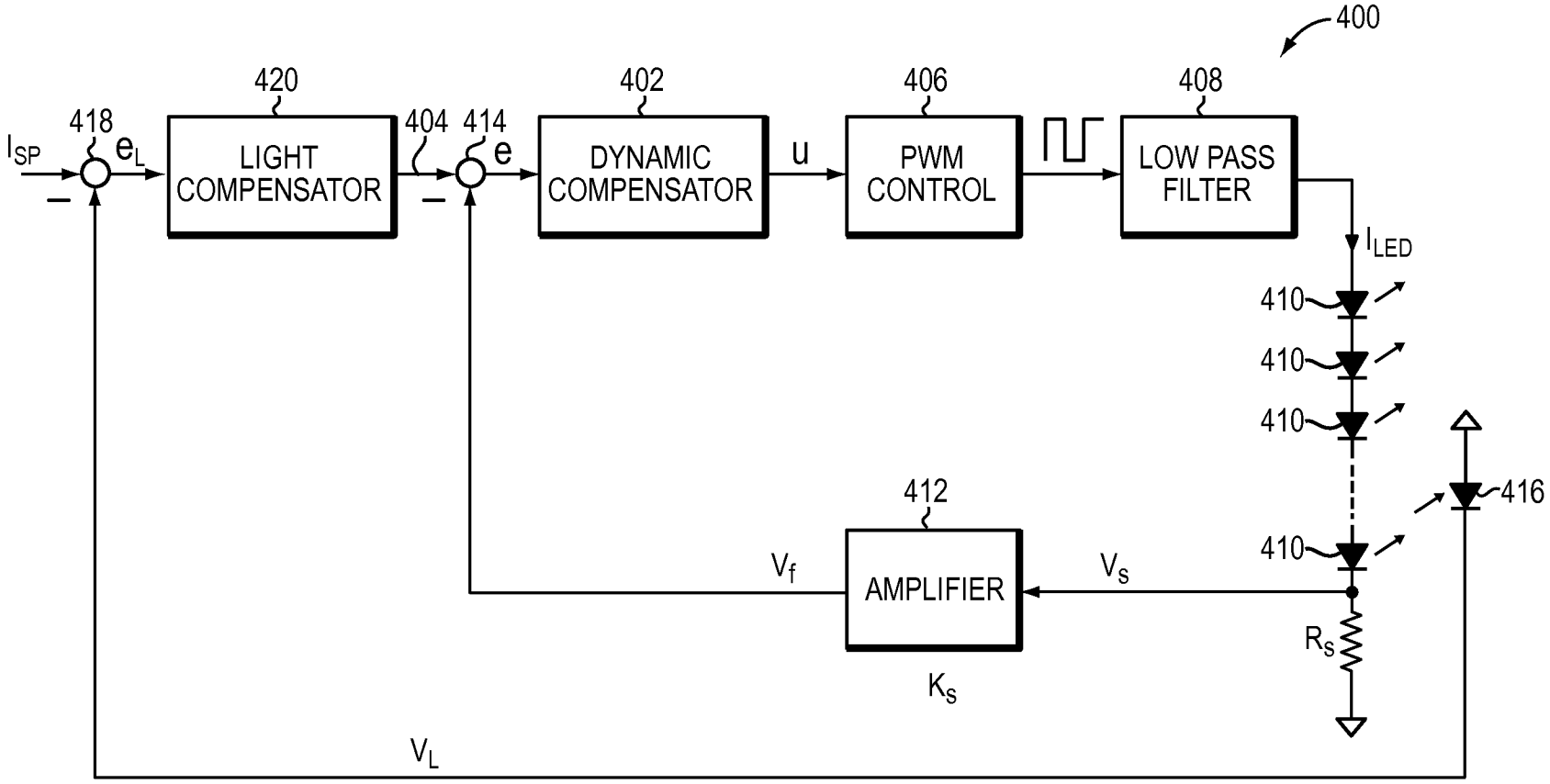
FIG. 4 illustrates a circuit for regulating current in one or more LEDs based on LED light output in accordance with embodiments of the present invention.

An exemplary circuit 400 for compensating for variations in detected light is illustrated in FIG. 4. A dynamic compensator 402 receives an error signal e that represents the difference between a feedback voltage $V_f$ and a compensation signal 404 and generates a control signal u in response. A PWM control circuit 406 varies its duty cycle in accordance with the control signal u and outputs a PWM signal that is filtered by a low-pass filter 408. The resultant LED drive current $I_{LED}$ drives one or more LEDs 410 (which may be configured in an LED string). A resistor $R_S$ samples the LED current $I_{LED}$ and, after amplification by an amplifier 412, a voltage $V_f$ based on the sensed current is compared to the input voltage 404 by a comparator 414.

In one embodiment, a light sensor 416 (such as a photodiode circuit or any other light-sensing device or circuit capable of converting an amount of received light into a corresponding electrical signal or level) senses light output by the one or more LEDs 410. The light sensor 416 generates a light-sense signal $V_L$ that is based on the sensed light, and a comparator 418 compares the light-sense signal $V_L$ to a desired LED current $I_{SP}$. A light compensator circuit 420 analyzes the error $e_L$ computed by the comparator 418 for static and/or dynamic offsets and generates a compensation signal 404 that is input to the first comparator 414. The compensation signal modifies the error signal e such that the dynamic compensator 402, PWM circuit 406, and low-pass filter 408 generates an LED drive current $I_{LED}$ that minimizes or eliminates the static and/or dynamic light fluctuations in the error signal $e_L$. For example, if the light output of the LEDs 410 includes a static offset from a prior-measured or desired light output, the light compensator 420 generates an output 404 that causes the drive current $I_{LED}$ to increase or decrease to reduce or eliminate the offset. If, in addition to or instead of the static offset, the light output of the LEDs 410 includes a dynamic offset, the light compensator 420 generates an output 404 that includes a time-varying component (e.g., a sinusoid) that increases and decreases the drive current $I_{LED}$ to reduce or eliminate the dynamic offset.

Figure 5:
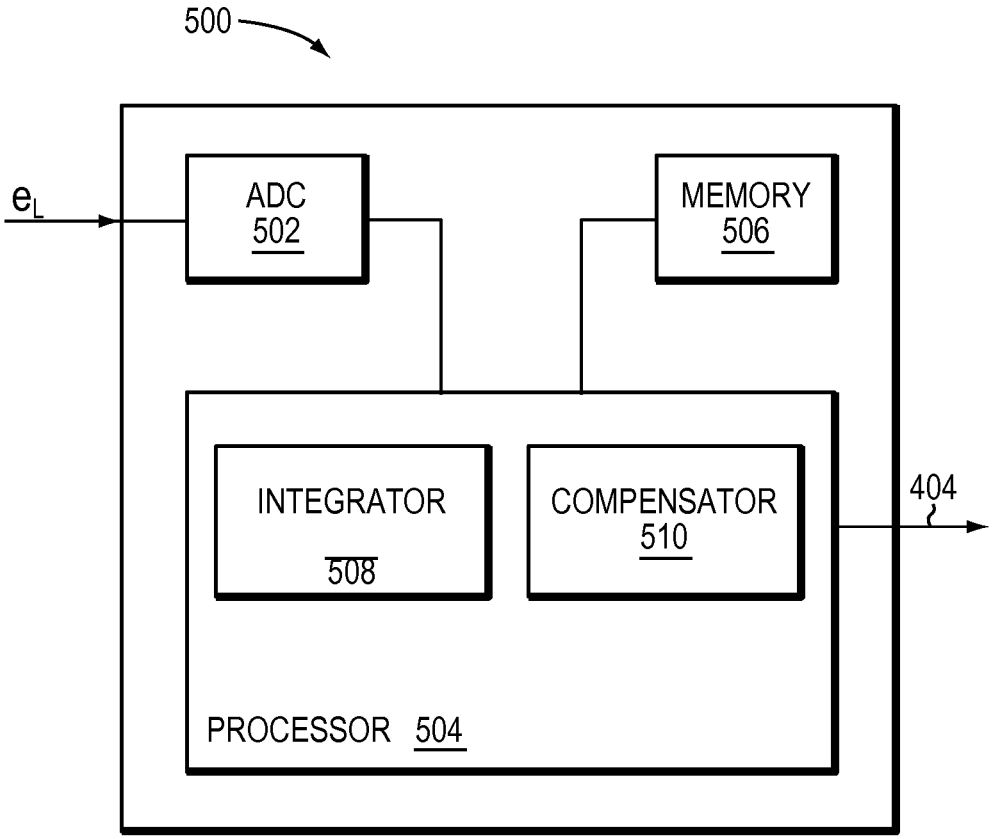
FIGS. 5 and 6 illustrate exemplary compensation controllers in accordance with embodiments of the present invention.

The light compensator 420 may include digital and/or analog circuitry and may be constructed in accordance with any system or circuit known in the art. In one embodiment, as shown in the block diagram 500 of FIG. 5, the light compensator 420 is constructed using digital circuitry. An analog-to-digital converter 502 converts the input error signal $e_L$ to a digital signal via sampling. A processor 504 modifies the error signal $e_L$ in accordance with a transfer function U(s,z) to thereby reduce or eliminate static and/or dynamic disturbances in the light output by the LEDs 410; the transfer function U(s,z) may be applied using a compensator 510; the compensator 510 may be implemented in firmware as an ordinary difference equation in accordance with techniques known in the art of digital control and signal processing systems. In one embodiment, the processor 504 includes an integrator 508 for correcting static disturbances. The processor 504 may be a microprocessor, digital-signal processor, microcontroller, ASIC, or any other type of processor, and may execute instructions encoded in software, firmware, and/or the memory 506. The present invention is not limited to the configuration of separate blocks for the integrator 508 and compensator 510; in some embodiments, the blocks 508, 510 are implemented as difference equations in firmware code.

Figure 6:
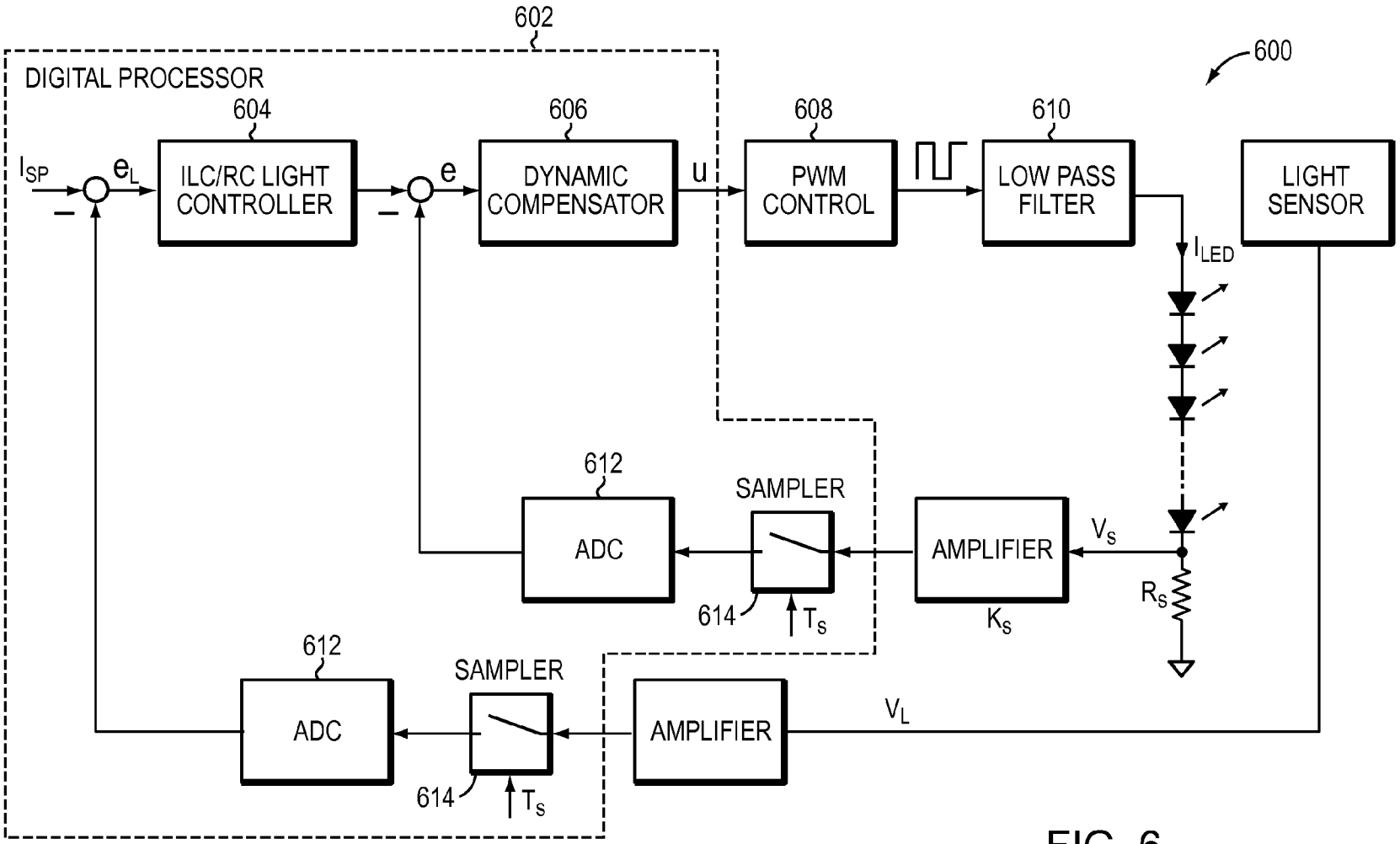

Another embodiment 600 of a digital implementation of the present invention appears in FIG. 6. A digital processor 602 includes an ILC/RC light controller/compensator block 604 for implementing an "intelligent" adaptive algorithm in accordance herewith; a dynamic compensator block 606 implements the inner loop control algorithm. In this embodiment, the algorithms are implemented by the blocks 604, 606 as purely software code, though any implementations are within the scope of the present invention. The two sampling rates $T_S$ used by the samplers 614 of each loop need not be the same sampling values; in some embodiments, the two control loops operate at different sampling rates (i.e., a so-called "multirate digital control system"). The PWM 608 and low pass filter 610 blocks together perform a combination of digital-to-analog conversion and power amplification. The ADC 612 and sampler 614 blocks may be implemented within, or external to, the processor 602.

In general, the light compensator 420 generates a model of the dynamic disturbance in the light output by the LEDs 410. A periodic signal having a period of $N/f_S$ (where $f_S$ is the sampling frequency of the ADC 502) may be modeled using the transfer function shown in Equation (1), below.

$$X_R(z) = \frac{1}{z^{N/f_S} - 1} \tag{1}$$

Thus, a general implementation of an RC-based light compensator 420 has a transfer function given by Equation (2), below.

$$U(z) = \frac{L_{RC}(z)}{z^{N/f_S} - Q_{RC}(z)} \tag{2}$$

A repetitive controller constructed in accordance with Equation (2) may be used to generate a sinusoid to correct for a sinusoid-like disturbance in the light output by the LEDs 410; one of skill in the art will understand, however, that disturbances in the light output may be modeled using a plurality of sinusoids, wavelets or other periodic functions defined by other transfer functions U(z). For example, a second sinusoid may be used to construct a smaller "ripple" signal on top of a larger sinusoid. Any other types of disturbance models (e.g., square-wave, triangle-wave, saw-tooth-wave, impulse, etc.) are within the scope of the present invention and may be used to compensate for different types of disturbances. In one embodiment, the processor 504 selects from one of a plurality of compensation models (e.g., ILC or RC) based on an analysis of the digitized inputs signal; the processor 504 may also cycle through a plurality of models and select the model that minimizes the error signal $e_L$. In one embodiment, an ILC/RC controller learns the type/shape of the disturbance and automatically and dynamically implements the correct control strategy by synthesizing the appropriate control signal that cancels or reduces the time-varying disturbance.

The design of the $L_{RC}(z)$ filter may be a constant gain (i.e., a proportional or "P-type") repetitive controller, a proportional-integral-derivative ("PID") controller, or any other type of controller suitable for a given set performance requirements (e.g., maximum allowable error level $e_L$). The $Q_{RC}(z)$ filter may be a low-pass filter to limit the bandwidth of the repetitive controller and ensure monotonic convergence.

As discussed briefly above, the processor 504 may account and correct for time-varying offsets in the light output by the LEDs 410 in a variety of ways. For example, the compensator 420 may implement an iterative-learning control ("ILC") system, a repetitive-control ("RC") system, or a run-to-run control ("R2R") system. In one embodiment (as described above), the light compensator 420 is a repetitive controller that produces a counteracting modulation signal based on the desired current $I_{SP}$ to change the current in such a way that the unwanted disturbance is cancelled. In general, ILC and RC controllers are adaptive controllers that adjust a control action, u, for a repetition j, by synthesizing a suitable actuation sequence based on a tracking error measured in a prior repetition (j−1). Unlike ordinary adaptive controllers, which adjust controller parameters such as gain and polynomial coefficients, ILC and RC controllers modify the actuation signal of the control system directly. ILC and RC controllers may compensate for the effects of disturbances if they are the same for every repetition, because the system learns from previous iterations and injects correction signals via feed-forward. By contrast, a non-learning controller produces the same tracking error on each pass of the repetition because no such changes are made. ILC/RC systems do not require that the reference or disturbance signals be known or measurable, only that these signals remain unchanged from iteration to iteration. ILC systems may be most appropriate for batch processes (in which a procedure is performed and then stops after which it is repeated again at a later time); RC systems may be most appropriate for continuous processes (in which a procedure is performed repeatedly over and over again without any pause between the iterations). For a batch process, the initial conditions are set to the same value at the start of each step; in a continuous process, the final conditions of the previous repetition become the initial conditions for the present repetition. Control theories, including RC and ILC methodologies, are well understood and described in, for example, "The Internal Model Principle of Control Theory" by Francis B. A. and Wonham W. M., (Automatica, vol. 12, pp 457-465, 1976); "Survey on iterative learning control, repetitive control and run-to-run control" by Wang Y., Gao F., and Doyle F. J., (Journal of Process Control, vol 19, pp 1598-1600, 2009); "Iterative learning control and repetitive control for engineering practice" by Longman R. W., (International Journal of Control, vol. 73, no. 10, pp 930-954, 2000); and "A Survey of Iterative Learning Control" by Bristow D. A., Tharayil M. and, Alleyne A. G., (IEEE Control Systems Magazine, pp 96-114, June 2006), which are hereby incorporated by reference in their entireties. In general, a discrete-time control system may be described by the state space formulation given below in Equations (3) and (4):

$$x(k)=Ax(k-1)+Bu(k-1)+w(k-1) \tag{3}$$

$$y(k)=Cx(k) \tag{4}$$

where x(k) is the state vector, u(k) is the input vector, y(k) is the output vector, w(k) is a disturbance sequence, and k is the discrete-time sample number (1, . . . , n). A repetition may be represented using a collection of vectors, each having a total of n samples. The vectors may be of finite-time duration, in contrast to the more usual infinite duration vectors in ordinary control system analysis. The disturbance w(k) describes any repeating deterministic disturbance sequence. Such a disturbance is not confined to signals such as sinusoids; it may be a time-indexed sequence of any arbitrary shape, provided that it is identical (or approximately so) for every repetition.

An ILC system may account for an error via the use of a "learning matrix." A typical ILC learning law is of the form $$u(j+1,k)=u(j,k)+Le(j,k) \tag{5}$$

where L is the learning gain matrix. Equation (5) shows that the actuation sequence for the iteration (j+1) is the same as that for the previous iteration, j, but with a correction factor added that depends on the error sequence of the $j^{th}$ iteration. The vectors u(j, k) and e(j, k) are each filled with n samples (for k=1 to n) of the actuation and error sequences, respectively, for repetition number j. The ILC control algorithm then calculates the actual control input actuation sequence u(j+1, k) for repetition (j+1) for all the k values up to n.

Figure 7:
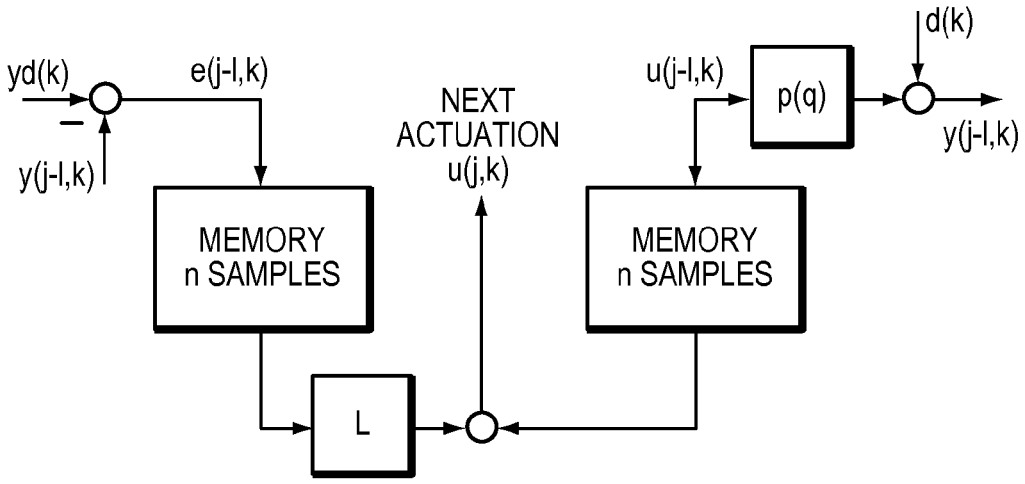
FIGS. 7, 8, and 9 illustrate examples of ILC compensation controllers.

The control law of equation (5) may be represented as shown in FIG. 7, for a plant described by $$y(j,k)=P(q)u(j,k)+d(k) \tag{6}$$

where P(q) is the discrete-time plant transfer function, P(z), in the corresponding time domain difference equation notation, with q being the forward shift operator such that qu(k)=u(k+1). The sequence d(k) is the repetitive disturbance entering the system.

If the learning matrix is chosen correctly and the system is asymptotically stable, the error signal decays to zero with time. In this situation, the shape of the actuation sequence (or signal), u, will be such that the repetitive disturbance occurring each iteration will be cancelled during each pass. The behavior of the error from one repetition to the next, follows the equation $$e(j,k)=(I-PL)e(j-1,k) \tag{7}$$

which may be expanded out from the initial iteration e(0, k) as $$e(j,k)=(I-PL)^j e(0,k) \tag{8}$$

To ensure that asymptotic convergence to zero of the error occurs, it is generally necessary to ensure that all the eigenvalues of the matrix (I−PL) are less than unity, i.e.

$$\|\lambda_i(I-PL)\|<1\forall i \tag{9}$$

Figure 8:
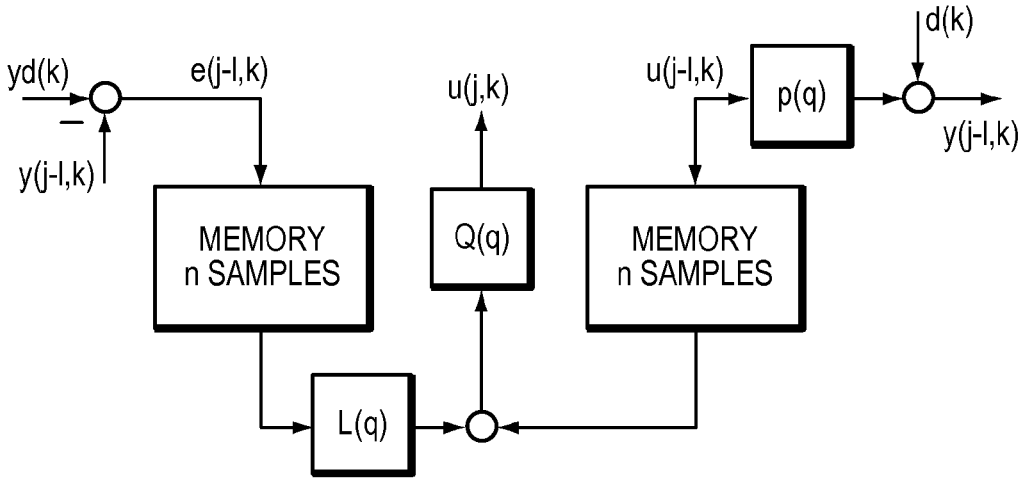

The simplest practical ILC control law is a proportional type where L is simply a gain. A non-causal control law of the form $$u(j+1,k)=u(j,k)+Le(j,k+1) \tag{10}$$

is implementable in practice because, when calculating u(j+1, k) for iteration (j+1), the entire data set of sequences for u(j, k) and e(j, k) are available, because they are stored in memory, so we have access to the error at sample time (k+1). The error at time step k for iteration j is given by $$e(j,k)=y_d(k)-P(q)u(j,k)-d(k) \tag{11}$$

and therefore $$e(j,k+1)=y_d(k+1)-P(q)u(j,k+1)-d(k+1) \tag{12}$$

so e(j, k+1), which is available when u(j+1, k) is calculated, may be regarded as a prediction or anticipation of the disturbance at time step (k+1), that is, it anticipates the disturbance d(k+1). A more general learning control law is given by $$u(j+1,k)=Q(q)[u(j,k)+L(q)e(j,k+1)] \tag{13}$$

which may be represented as shown in FIG. 8. In this case, we have a dynamic learning gain matrix L(q) and an additional filter Q(q) to help with asymptotic stability. For this system, convergence and asymptotic stability is achieved only if $$\|\lambda_i(Q(I-LP))k\|<1\forall_i \tag{14}$$

RC systems may be applicable to situations in which continuous repetitive processes occur, such as a continuous, uniform disturbance in light emitted by an LED and/or from other sources. RC systems may deal with the frequency domain and be based on the use of the Internal Model Principle, which roughly states that, to completely reject a disturbance or perfectly track an input trajectory, the control loop contains a model of the disturbance or input signal. Consider the following simple discrete-time transfer function:

$$H(z) = \frac{1}{z^T - 1} \tag{15}$$

Figure 9:
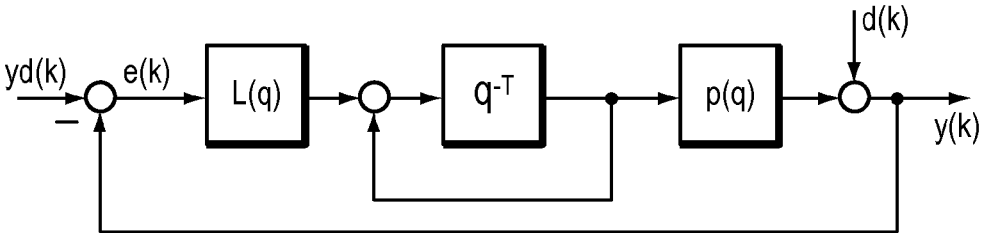
Figure 10:
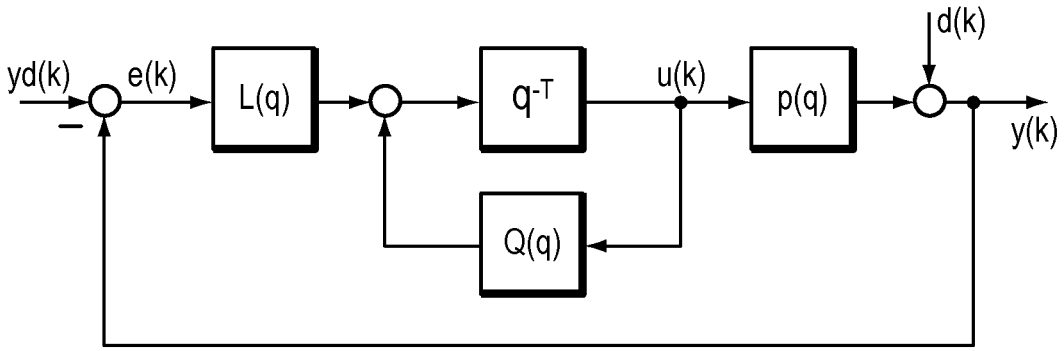
FIGS. 10 and 11 illustrate examples of RC-based compensation controllers.
Figure 11:
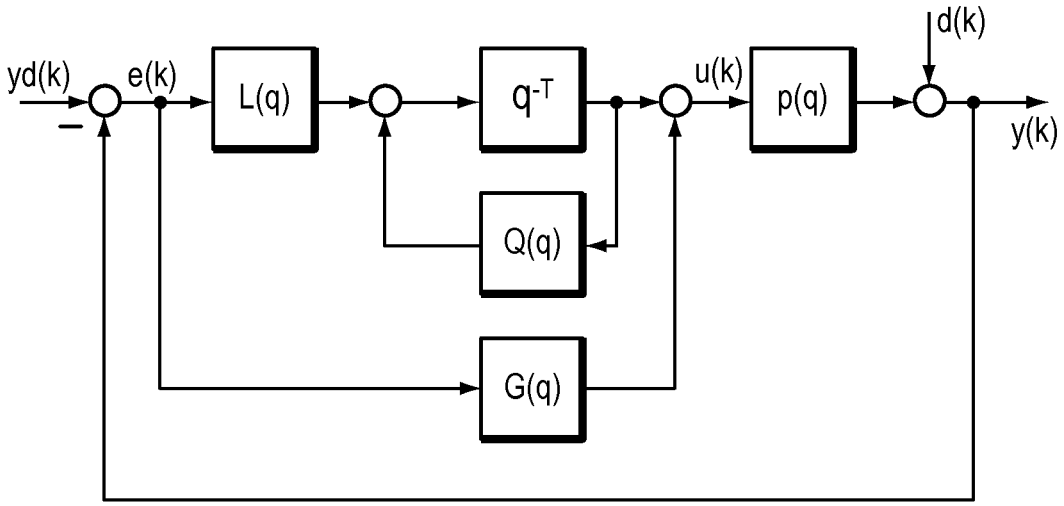

A sampled signal sequence of length N samples for a duration of T seconds can be made to repeat with period T seconds by passing it through a filter H(z). Using the Internal Model Principle, if the disturbance is a pure sinusoid, a model of this sinusoid is included in the control system. Such a system is be a special case of the repetitive generator of Equation (15). A basic RC system incorporating the repetitive generator is as shown in FIG. 9; FIG. 10 illustrates a more general RC that includes the Q filter discussed above with reference to ILC systems. As previously mentioned, the properly designed "pure" RC system may ensure elimination or reduction of the effects of disturbances, provided that they are the same and repeat every iteration. To handle the other types of disturbances and uncertainties, an implementation of a control system in accordance with embodiments of the present invention incorporates a conventional negative feedback system with the RC system, as shown in FIG. 11, in which G(q) is an ordinary, classically designed discrete-time control loop compensator. Other design techniques can also be used to design the control system using many "modern control" theory methods, as one of skill in the art will understand; these other control theories are all within the scope of the present invention. The parameters of L(q) and Q(q) may be designed to ensure overall system stability and convergence of the tracking error for repetitive disturbances.

The present invention is not limited to any particular type of controller 420 or any particular number or arrangement of components therein; one of skill in the art will understand that the functionality of the compensator 420 may be implemented in a variety of ways (e.g., as an RC system, an ILC system, and/or a combination RC/ILC system selectable by the compensator or a higher-level control system based on analysis of the disturbance pattern). The ADC 502 may be integrated within the processor 504, and the compensator 510 may be implemented wholly or partially using analog components.

In one embodiment, the disturbances in the light output of the LEDs 410 are found to be substantially sinusoidal (or the system may be configured, for simplicity, to limit correction to a sinusoidal correction profile), and the processor 504 includes a compensator 510 to correct for these disturbances. The compensator 510 may implement a transfer function and/or a particular type of filter, such as a Kalman filter; the present invention is not limited to any particular type of filter or compensator. For example, the compensator 510 may be a runout filter having a transfer function given by Equation (16), below.

$$U_R(z) = \frac{z^2 - 2a\cos(\theta)z + a^2}{z^2 - 2\cos(\theta)z + 1} \tag{16}$$

where θ is defined as follows:

$$\theta = \frac{2\pi f_d}{f_s} \tag{17}$$

In Equation (17), $f_s$ is the sampling rate, a is a peaking factor close to, but less than unity, and $f_d$ is the frequency of the time-varying disturbance in the light output by the LEDs 410. The transfer function $U_R(z)$ includes an internal model of a sinusoidal generator having an impulse response, which is a sinusoidal waveform. $U_R(z)$ may be used to reject a periodic sinusoidal disturbance of frequency $f_d$ because it has (i) complex-conjugate zeros located at an angular frequency θ and a radius a near the unit circle in the z-domain and (ii) complex-conjugate poles (at the same frequency as the zeros) located on or near the unit circle in the z-domain. The frequency-response magnitude thus has a large resonant peak at the frequency $f_d$ of the sinusoidal disturbance.

For static offsets, the digitized signal output by the ADC 502 may be compared to a prior value (i.e., a measure of the light output by the LEDs 410 at an earlier point in time). Any static offset in the current value of the digitized signal may cause the integrator 508 to ramp up or down, causing the error signal $e_L$ to move toward zero. In other embodiments, the processor 504 compares the current light output to ideal or desired values of light output at given levels of desired current $I_{SP}$. In one embodiment, a memory 506 includes a table of one or more values of desired light output versus a current hp level, and the processor 504 loads an appropriate value of desired light output from the memory 506. The memory 506 may be RAM, ROM, flash, or any other kind of memory. If the digitized signal differs from the desired level, the processor 504 generates an output signal 404 that corrects for the detected static offset. In other embodiments, the output signal 404 is generated from a modeled or analytic relationship between the offset and the current $I_{SP}$. In one implementation, the processor includes a circuit or firmware module for an integrator 508 that samples the digitized signal over time; the processor 504 generates the output signal 404 based on the output of the integrator 508, which represents the history of the light output by the LEDs 410. In still other embodiments, a static offset may be detected by comparing the light output from different LEDs 410 having similar drive currents and detecting differences therebetween.

In various embodiments, the compensator 420 corrects for fundamental and harmonic components of the dynamic offsets in the light output of the LEDs 410. The frequency-response magnitude of the repetitive-controller filter may resemble that of a comb filter, having high-gain resonant peaks at integer multiples of the harmonic frequency of the repetitive time-varying disturbance. The resonant peak magnitudes at each frequency reduce or cancel the fundamental, as well as all the harmonic components of the disturbance signal entering the system.

In one embodiment, the light sensor 416 receives light from only, or from primarily, one or more of the LEDs 410. A light shield may be disposed between the light sensor 416 and other sources of light, such as other LED, incandescent, halogen, or fluorescent bulbs, sunlight, or other ambient light; the light shield permits light from the LEDs 410 to strike the light sensor, however. The light shield may be made of metal, plastic, or any other light-blocking material, and may be affixed to, for example, an LED lamp housing. In other embodiments, the light sensor 416 is tuned to detect only the frequency or wavelength of light output by the LEDs 410 (and/or a particular frequency or spectral component of the light output by the LEDs 410). In still other embodiments, a plurality of light sources 410 may be used to distinguish between the LEDs 410 and other sources; for example, based on differences in phase in the light received by each of the plurality of light sources 410, the compensator 420 may compute the direction (i.e., angle with respect to the light sources 410) of each disturbances and rule out disturbances stemming from other light sources based on a known spatial relationship between the light sensors 416 and the LEDs 410. In these embodiments, the compensator 420 compensates for static or dynamic offsets in only the light produced by the LEDs 410.

In other embodiments, the light sensor 416 receives light from additional light sources instead of, or in addition to, light from the LEDs 410, such that the current/brightness of the LEDs 410 is modulated so as to cause the overall light intensity in the vicinity of the light sensor to be controlled with respect to the imposed setpoint. In other words, when a flickering light nearby is sensed with the sensor, whether the light originates from the LEDs 410 or any other source, the control loop will create an "antiphase" light signature ("antiflicker") that will cause the average overall light value from all sources to be equal to the setpoint command. The additional light sources may be light sources other than the LEDs 410 not in electrical communication with the circuit 400. These other light sources may include, for example, another, independently powered and/or controlled light disposed in the same room or area as the LEDs 410. In these embodiments, the light sensor 416 may sense a dynamic disturbance in the light received from other sources (i.e., flickering); this flickering causes a variation in the light-source feedback signal $V_L$, which is compensated for by the compensator 420. The output 422 of the compensator 420 thus causes the LEDs 410 to vary their output light in accordance with the sensed flickering, thereby compensating for the flickering in the other light sources. For example, if another light source produces light that dips in intensity on a period basis, the light output by the LEDs 410 increases on a periodic basis to counteract the dipping light levels in the other sources. In other embodiments, the light sensor 416 receives light from both the LEDs 410 and the other sources, and the compensator 420 produces an output signal 422 that causes the light output by the LEDs 410 to vary in accordance with the aggregate variations in both the LEDs 410 and the other sources.

It should also be noted that embodiments of the present invention may be provided as one or more computer-readable programs embodied on or in one or more articles of manufacture. The article of manufacture may be any suitable hardware apparatus, such as, for example, a floppy disk, a hard disk, a CD ROM, a CD-RW, a CD-R, a DVD ROM, a DVD-RW, a DVD-R, a flash memory card, a PROM, a RAM, a ROM, or a magnetic tape. In general, the computer-readable programs may be implemented in any programming language. Some examples of languages that may be used include C, C++, or JAVA. The software programs may be further translated into machine language or virtual machine instructions and stored in a program file in that form. The program file may then be stored on or in one or more of the articles of manufacture.

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. A system for compensating for a time-varying disturbance in light output by a light source, the system comprising:

a light sensor configured for sensing light output by a light source and for generating a light-sense signal based thereon;

an adaptive controller circuit configured for adjusting a control signal u in a repetition j by:

(i) measuring a tracking error caused by a characteristic of the time-varying disturbance in the light-sense signal in a prior repetition j−1, (ii) generating a correction factor based on the tracking error, and (iii) modifying the control signal u in the repetition j based on the control signal u in the prior repetition j−1 and the correction factor; and a driver circuit configured for driving an LED in accordance with the control signal to thereby compensate for the time-varying disturbance, wherein the adaptive controller circuit comprises at least one of a repetitive controller, an iterative-learning controller, or run-to-run controller.

2. The system of claim 1, wherein the characteristic of the time-varying disturbance comprises (i) a frequency, (ii) a wave form, or (iii) whether the disturbance is dynamic and, if so, whether it exhibits periodicity.

3. The system of claim 2, wherein the adaptive controller circuit is further configured for selecting a signal model based on the characteristic and wherein the control signal is modified using the signal model.

4. The system of claim 1, further comprising a negative feedback controller for compensating for an aperiodic component of the disturbance.

5. The system of claim 1, wherein the light source is the driven LED or a LED string.

6. The system of claim 1, wherein the light source is a source other than the driven LED.

7. The system of claim 1, wherein the light source is not in electrical communication with the system.

8. The system of claim 1, wherein the adaptive controller circuit implements a transfer function for generating the output signal.

9. The system of claim 1, wherein the adaptive controller circuit comprises a digital processor and memory.

10. The system of claim 1, wherein the adaptive controller circuit comprises an integrator for detecting a static disturbance.

11. The system of claim 1, further comprising a light shield for shielding the light sensor from light not produced by the LED.

12. A method for compensating for disturbances in light output by a light source, the method comprising:

sensing light output by a light source and generating a light-sense signal based thereon;

detecting a time-varying disturbance in the light-sense signal;

measuring a tracking error caused by a characteristic of the time-varying disturbance in the light-sense signal in a prior repetition j−1;

generating a correction factor based on the tracking error;

modifying a control signal u in the repetition j based on the control signal u in the prior repetition j−1 and the correction factor; and driving an LED in accordance with the control signal to thereby compensate for the time-varying disturbance, wherein the disturbance is aperiodic and a negative feedback controller is configured for generating the output signal based on iterative learning of the disturbance.

13. The method of claim 12, wherein the characteristic of the time-varying disturbance is one of (i) a frequency, (ii) a wave form, or (iii) whether the disturbance is dynamic and, if so, whether it exhibits periodicity.

14. The method of claim 12, further comprising selecting a signal model based on at least one characteristic, wherein the output signal is generated using the signal model.

15. The method of claim 12, wherein the light source is the LED.

16. The method of claim 12, wherein the light source is a source other than the LED.

17. The method of claim 12, wherein the disturbance is static.

18. The method of claim 12, wherein generating the output signal comprises generating a sinusoid.

19. The method of claim 12, further comprising detecting a periodic disturbance and comparing the light-sense signal with a reference signal.

* * * * *